US008104315B2

(12) United States Patent
Perthou

(10) Patent No.: US 8,104,315 B2
(45) Date of Patent: Jan. 31, 2012

(54) KEY RING

(76) Inventor: Peter Perthou, Rockport, MA (US)

( * ) Notice: Subject to any disclaimer, the term of this patent is extended or adjusted under 35 U.S.C. 154(b) by 2605 days.

(21) Appl. No.: 09/752,015

(22) Filed: Dec. 29, 2000

(65) Prior Publication Data

US 2001/0018838 A1 Sep. 6, 2001

Related U.S. Application Data

(63) Continuation of application No. 29/104,549, filed on May 7, 1999, now Pat. No. Des. 435,720.

(51) Int. Cl.
*A44B 15/00* (2006.01)

(52) U.S. Cl. ..... 70/456 R; 70/459; D3/207; 224/602; 206/38.1

(58) Field of Classification Search ..... 70/456 R–459; D3/61, 62, 64, 65, 207–212; 24/3 K, 3.1, 24/3.6, 3.13, 200, 256 R, 256 C, 256 EC, 24/56 R; 224/602, 603; 206/37, 37.1, 37.8, 206/38.1, 1.5
See application file for complete search history.

(56) References Cited

U.S. PATENT DOCUMENTS

| | | | | | |
|---|---|---|---|---|---|
| 119,400 | A * | 9/1871 | Penrose | 224/148.6 |
| 689,872 | A * | 12/1901 | Griscom | 206/37.8 |
| 1,128,149 | A * | 2/1915 | Jennings | 224/602 |
| 1,143,825 | A * | 6/1915 | Hausammann | 150/100 |
| 1,313,851 | A * | 8/1919 | Hansgen | 70/456 R |
| 1,693,006 | A * | 11/1928 | Thomas | 206/38.1 |
| 1,704,137 | A * | 3/1929 | Miller | 206/37.8 |
| 3,620,057 | A * | 11/1971 | Holland | 70/456 R |
| 4,085,872 | A * | 4/1978 | Foo | 224/602 |
| 4,121,822 | A * | 10/1978 | DiSabatino et al. | 482/88 |
| 4,407,148 | A * | 10/1983 | Rousseau | 70/456 R |
| 4,523,443 | A * | 6/1985 | Momemers | 70/459 |
| 4,601,185 | A * | 7/1986 | Sheldon | 70/456 R |
| 4,739,877 | A * | 4/1988 | Olson | 206/38.1 |
| 4,903,514 | A * | 2/1990 | Jung | 70/456 R |
| 4,907,694 | A * | 3/1990 | Miller et al. | 206/81 |
| 4,934,528 | A * | 6/1990 | Miller et al. | 206/235 |
| 5,042,649 | A * | 8/1991 | McNutt | 206/38.1 |
| 5,069,050 | A * | 12/1991 | Chen | 70/456 R |
| D335,217 | S * | 5/1993 | Seitz | D3/62 |
| D380,084 | S * | 6/1997 | Kebarian | D3/207 |
| D387,553 | S * | 12/1997 | Fritsche | D3/211 |
| 5,899,501 | A * | 5/1999 | Maxwell | |
| 6,000,103 | A * | 12/1999 | Paice et al. | 24/10 R |
| 6,095,093 | A * | 8/2000 | Kisko et al. | 119/770 |
| 6,141,999 | A * | 11/2000 | Whittaker et al. | 70/456 R |
| 6,148,993 | A * | 11/2000 | Chisolm et al. | 206/38.1 |
| D435,720 | S * | 1/2001 | Perthou | D3/205 |
| 6,375,056 | B1 * | 4/2002 | Henri | 224/603 |
| 6,427,374 | B1 * | 8/2002 | Vaiani | 42/85 |
| 6,491,196 | B1 * | 12/2002 | Coler | 224/602 |
| 6,695,022 | B2 * | 2/2004 | Morehead | 150/134 |

* cited by examiner

*Primary Examiner* — Suzanne Barrett
(74) *Attorney, Agent, or Firm* — Fish & Richardson P.C.

(57) ABSTRACT

A key ring includes a D-ring, and a key-holding ring. The D-ring couples the key-holding ring to a band.

7 Claims, 2 Drawing Sheets

KEY RING

CROSS-REFERENCE TO RELATED APPLICATIONS

This application is a continuing application of U.S. application Ser. No. 29/104,549, filed on May 7, 1999 now U.S. Pat. No. Des. 435,720, entitled KEY-RING.

STATEMENT REGARDING FEDERALLY SPONSORED RESEARCH OR DEVELOPMENT

Not Applicable.

BACKGROUND OF THE INVENTION

The present invention relates in general to key rings and more particularly concerns a novel key ring including a D ring coupling a key-holding ring to a band.

For background, reference is made to U.S. Pat. Nos. 2,531,325, 3,126,603, 4,037,443, 4,164,132, 4,523,442, 4,765,460, 5,341,662, 5,388,740 and 5,495,734 and other patents in subclasses 456R and 459 of class 70.

BRIEF SUMMARY OF THE INVENTION

According to the invention, there is a D ring coupling a key-holding ring to a band. Typically, the key-holding ring resides in the U-shaped portion of the D ring with the bar of the D ring connected to each end of the U-shaped portion residing in the band. The band typically comprises a length of material looped through the D-ring and clamped together at the ends, its width typically corresponding to slightly less than the distance between the legs of the U-shaped portion of the D-ring.

It is an important object of the invention to provide an improved key ring.

Other features, objects and advantages of the invention will become apparent from the following detailed description when read in connection with the accompanying drawing in which:

BRIEF DESCRIPTION OF THE SEVERAL VIEWS OF THE DRAWING

Like reference symbols in the various views indicate like elements.

DETAILED DESCRIPTION

Figure 1:
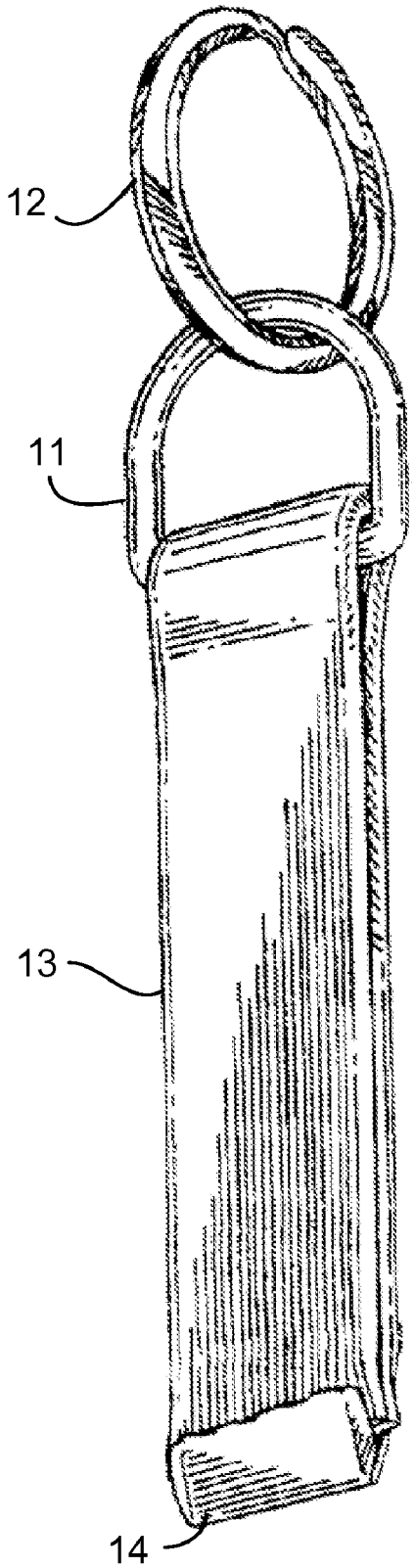
FIG. 1 is a perspective view of a key ring according to the invention.
Figure 2:
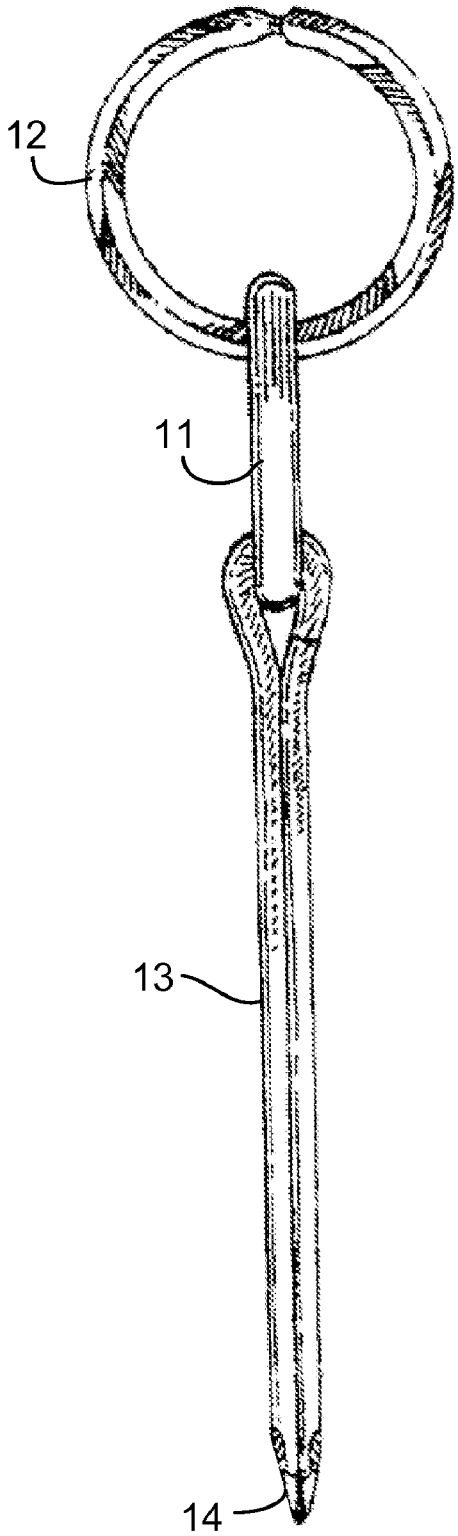
FIG. 2 is a side view thereof.
Figure 3:
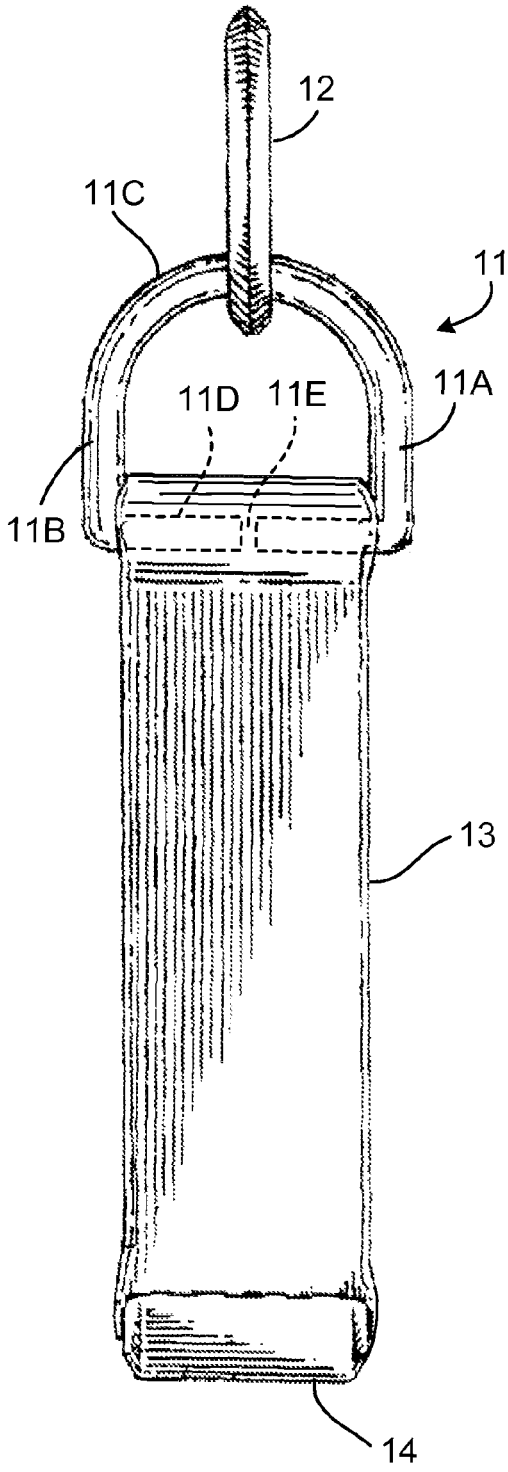
FIG. 3 is a plan view thereof.
Figure 5:
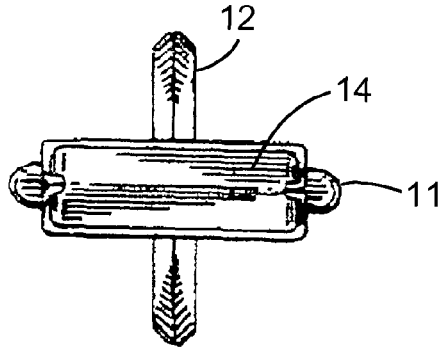
FIG. 5 is a bottom view thereof.
Figure 4:
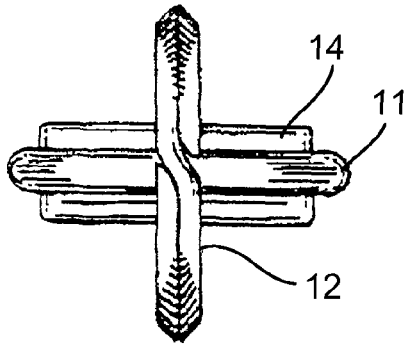
FIG. 4 is a top view thereof.

With reference now to the drawing and more particularly FIGS. 1-5 thereof, there are shown perspective, side, plan, top and bottom views of an embodiment of the invention. A D ring 11 couples a key-holding ring 12 to web 13. Web 13 is a piece of material looped through D-ring 11 and clamped together at its ends by clamp 14.

Key-holding ring 12 is typically of a conventional type comprising a metal resilient spiral that allows entry of a key at opening 12A when adjacent portions of the spiral are forced apart to admit the key, and further rotation of key-holding ring 12 allows the remaining portions of the spiral to reside within a hole in the keyhead in a conventional manner.

D-ring 11 has a U-shaped portion comprising legs 11A and 11B between the U ends of the U joined by bight 11C with a bar 11D formed with a small gap 11E in the middle extending between legs 11A and 11B of length corresponding substantially to the distance between the U ends, and residing in the loop formed by band 13. The width of gap 11E, typically about ⅛ inch wide, is about the span or diameter of the cross section of the material forming key holding ring 12 to facilitate insertion of the latter into D-ring 11 during assembly. The opposed portions of the band are preferably fastened together for most of its length as shown, to define an opening 13A accommodating bar 11D.

Band 13 comprises a web of material looped through D-ring 11 so that D ring 11 is free to rotate about the axis of bar 11D and is clamped at its ends by clamp 14. The web material may be nylon or cotton webbing, but could be leather or plastic.

Referring to FIG. 6, there is shown a plan view of another embodiment with clamp 14' extending slightly beyond the width of band 13 and having rounded corners.

The invention has a number of advantages. Key-holding ring 12 may be rotated about the axis of bar 11D through nearly 360 degrees as D-ring 11 rotates about this axis from engaging one side of band 13 to the other. Key-holding ring 12 is also free to ride along the inside portion of the U-shaped portion of D-ring 11 through substantially 180 degrees about an axis perpendicular to the axis of bar 1 ID and the plane of band 13.

The invention allows a linear material to be used as the body of the key ring; that is, the fob which may be held in the hand, such as web or band 13. The D-ring and key ring connection according to the invention allows a fob to be held so that keys can move in any direction. The gap 11E in the D-ring facilitates manufacture by allowing a spiral key ring to be easily and economically slid into the D-ring, the gap width typically being about the span or diameter of the spiral ring material cross section. Passing the web through the D-ring allows the latter to couple the former to the key ring.

There has been described a novel key ring. It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

The invention claimed is:

1. A key ring comprising

A key-holding ring having a cross sectional span a band, a D-ring coupling said band to said key-holding ring, said D-ring having a U-shaped portion engaging the key-holding ring and a bar having bar ends between the U ends of the U-shaped portion of length corresponding to the distance between the U ends and engaging the band over substantially the entire length of the bar formed with a gap intermediate the U ends of gap width about that of said cross-sectional span to allow said key-holding ring to pass through said gap into said D-ring during assembly.

2. A key ring in accordance with claim 1 wherein the band is a web of material having band ends looped through the D-ring and joined at said band ends.

3. A key ring in accordance with claim 2 and further comprising a clamp at the band ends of said web of material.

4. A key ring in accordance with claim 2 wherein the web has portions that are fastened together for most of their length to define an opening accommodating the bar of the D-ring so that the D-ring may rotate about the axis of the bar through an angle of nearly 360 degrees and the key-holding ring may ride along the inside portion of the U-shaped portion of the D-ring about an axis perpendicular to the axis of the bar and perpendicular to the band for substantially 180 degrees.

5. A key ring in accordance with claim 3 wherein the clamp width is substantially the same as the width of the band.

6. A key ring in accordance with claim 1 where said key-holding ring is a spiral ring.

7. A method of making a key ring that includes a key-holding ring having a cross-sectional span, a band, a D-ring coupling said band to said key-holding ring and having a U-shaped portion engaging the key-holding ring and a bar having bar ends between the U ends of the U-shaped portion of length corresponding to the distance between the U ends formed with a gap intermediate said bar ends of gap width about that of said cross-sectioned span to allow said key-holding ring to pass through said gap into said D-ring during assembly, comprising, passing the key-holding ring through the gap into the D-ring, passing the band through the D-ring about the bar so that opposed portions of the band may be fastened together for most of the length of the band, and fastening the opposed portions together.

* * * * *